US008023881B2

(12) United States Patent
Watanabe et al.

(10) Patent No.: US 8,023,881 B2
(45) Date of Patent: Sep. 20, 2011

(54) SHEET FINISHER AND IMAGE FORMING SYSTEM PROVIDED THEREWITH

(75) Inventors: Masayuki Watanabe, Fuchu (JP); Eiji Sugimoto, Hino (JP); Hideo Yamane, Hachioji (JP); Takumi Shirakuma, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1036 days.

(21) Appl. No.: 11/857,062

(22) Filed: Sep. 18, 2007

(65) Prior Publication Data

US 2008/0298867 A1 Dec. 4, 2008

(30) Foreign Application Priority Data

Jun. 4, 2007 (JP) ..... 2007-147889

(51) Int. Cl.
*G03G 15/00* (2006.01)

(52) U.S. Cl. ..... 399/407; 399/389; 399/396; 399/402; 399/403; 399/404; 270/58.07

(58) Field of Classification Search ..... 399/407, 399/389, 396, 402, 403, 404; 270/58.07
See application file for complete search history.

(56) References Cited

U.S. PATENT DOCUMENTS 4,451,027 A * 5/1984 Alper ..... 271/10.02
7,207,557 B2 4/2007 Kaneko et al.
2004/0247356 A1* 12/2004 Kaneko et al. ..... 399/407
2005/0110818 A1* 5/2005 Sakakibara et al. ..... 347/16
2007/0176349 A1* 8/2007 Gerlier et al. ..... 271/10.03

FOREIGN PATENT DOCUMENTS

JP 2002-128384 5/2002
JP 2003-54809 2/2003

* cited by examiner

*Primary Examiner* — Judy Nguyen
*Assistant Examiner* — Andy Pham
(74) *Attorney, Agent, or Firm* — Finnegan, Henderson, Farabow, Garrett & Dunner, L.L.P.

(57) ABSTRACT

A sheet finisher having a post-processing section that conducts post-processing on a sheet on which an image has been formed by an image forming apparatus, the sheet finisher comprising: an intermediate storing section in which a plurality of sheets conveyed from the image forming apparatus are superposed to be stored temporarily; a pair of conveyance rollers that convey the plurality of sheets stored in the intermediate storing section to the post-processing section while the plurality of sheets are superposed; each of two drive motors which drives one of the pair of conveyance rollers that comes in contact with one sheet of the plurality of sheets and the other of the pair of conveyance rollers that comes in contact with the other sheet of the plurality of sheets, separately; and a correction controller that controls a rotation speed of at least one of the two drive motors.

8 Claims, 9 Drawing Sheets

SHEET FINISHER AND IMAGE FORMING SYSTEM PROVIDED THEREWITH

This application is based on Japanese Patent Application No. 2007-147889 filed on Jun. 4, 2007, which is incorporated herein by reference.

BACKGROUND OF THE INVENTION

The present invention relates to a sheet finisher that conducts post-processing for a sheet and to an image forming system provided with the sheet finisher.

In the case of an image forming apparatus forming an image on a sheet at high speed as in an electrophotographic image forming apparatus, it is possible to provide an image forming system capable of meeting broad users needs, by connecting a sheet finisher having various sheet-processing functions to the image forming system.

For example, in Unexamined Japanese Patent Application Publication No. 2002-128384, there is disclosed an image forming system wherein an image forming apparatus has a sheet finisher having therein functions for a punching process, for binding process and for folding process.

The specification of U.S. Pat. No. 7,207,557 discloses an image forming system wherein there is arranged a common single-sheet processing device between an image forming apparatus and at least one type of a sheet finisher among plural types of sheet finishers.

In the case of an image forming system described in Unexamined Japanese Patent Application Publication No. 2002-128384, it is effective when it is installed in the environment where various types of users use it in various ways, as in offices, for example, because a sheet finisher is constructed to exhibit various functions for post-processing in a single device. Further, the sheet finisher of this kind is relatively compact, which is also effective for the office where space saving is required.

On the other hand, in the image forming system such as a short-run printing system, an image forming system does not always need to be equipped with all post-processing functions, and a certain specific post-processing function only can meet the needs sufficiently in many cases. Namely, when using as an image forming system such as short-run printing, a specific user uses a specific post-processing function only more frequently than in the occasion where various types of users use in various ways as in the case of using in the office.

In the aforesaid image forming apparatus, a single relatively compact sheet finisher has various post-processing functions to meet various usage patterns. However, if individual post-processing function is observed by specifying it, that post-processing function is not regarded to be at a sufficient level.

In recent years, an image forming apparatus of an electrophotographic method has come to be used in a short-run printing field. Namely, using the image forming apparatus equipped with the sheet finisher mentioned above makes it possible to achieve bookbinding of a print-on-demand system for making necessary number of sets only when they are needed.

In addition, no time is required for preparation of a printing plate which has been needed in conventional printing, whereby, enhancement of efficiency of bookbinding work and cost reduction therefore are greatly expected.

The image forming system described in U.S. Pat. No. 7,207,557 is an apparatus capable of meeting the aforesaid demands, and it is an image forming system with a structure wherein a single-sheet processing device representing one type of sheet finisher is connected on the side of a sheet-ejection portion of an image forming apparatus, and further, at least one type of sheet finisher among plural types of sheet finishers is connected to the single-sheet processing device.

Further, in the image forming apparatus, or in the image forming system wherein the sheet finisher is connected to the image forming apparatus, it is desired that the number of sheets processed per unit time (hereinafter referred to as productivity) is large. In the field of short-run printing, in particular, that demand is strong. The number of sheets processed by the image forming system is determined by the capacity of a sheet finisher in many cases, rather than by the capacity of an image forming apparatus.

Namely, in the sheet finisher, it is necessary to keep a sufficient space between continuous sheets (hereinafter referred to as space-between-sheets) because conveyance of a sheet is stopped temporarily for processing in many cases. As a measure for that purpose, a conveyance speed in the sheet finisher is made to be higher than that in the image forming apparatus. However, in the recent speeding up, the conveyance speed in the sheet finisher is approaching the limits, because the conveyance speed of the image forming apparatus is made to be higher.

Therefore, Unexamined Japanese Patent Application Publication No. 2003-54809 discloses a sheet finisher wherein a reversal conveyance section accepting plural stacked sheets is provided in the finisher, and plural sheets stacked on the reversal conveyance section are conveyed simultaneously. By conveying plural sheets simultaneously while they are superposed, it is possible to broaden the space-between-sheets as far as the superposed sheets, without enhancing the conveyance speed, namely, to improve productivity in the sheet finisher.

However, in the sheet finisher disclosed by Unexamined Japanese Patent Application Publication No. 2003-54809, sheets are compelled to be conveyed through a curved conveyance path (hereinafter referred to as a curved portion) while they are superposed. Therefore, a sheet conveyed through the inside of the curved portion is different from that conveyed through the outside of the curved portion in terms of a length of the conveyance path and of frictional force between a wall surface of the curved portion and a sheet. Due to this, sheet displacement is caused between the inside sheet and the outside sheet.

In the short-run printing field, qualitative request about positional accuracy in post-processing is strict, and conducting post-processing under the condition of this sheet displacement leads to occurrence of defective articles.

It is possible to provide an alignment mechanism such as a stopper member for correcting sheet displacement. However, in this case, the structure is complicated, resulting in cost increase, and a period of time for alignment is needed, making it impossible to achieve original objective to improve productivity in a sheet finisher.

SUMMARY OF THE INVENTION

According to one embodiment of the present invention, a sheet finisher having a post-processing section that conducts post-processing on a sheet on which an image has been formed by an image forming apparatus, is provided with an intermediate storing section in which plural sheets conveyed from the image forming apparatus are superposed to be stored temporarily, a pair of conveyance rollers that convey plural sheets stored in the aforesaid intermediate storing section to the post-processing section while the sheets are superposed, two drive motors which respectively drive one roller of the pair of conveyance rollers coming into contact with one sheet of the plural sheets and the other roller coming into contact with the other sheet separately, and a correction controller that controls a rotation speed of at least one of the two drive motors.

Figure 6:
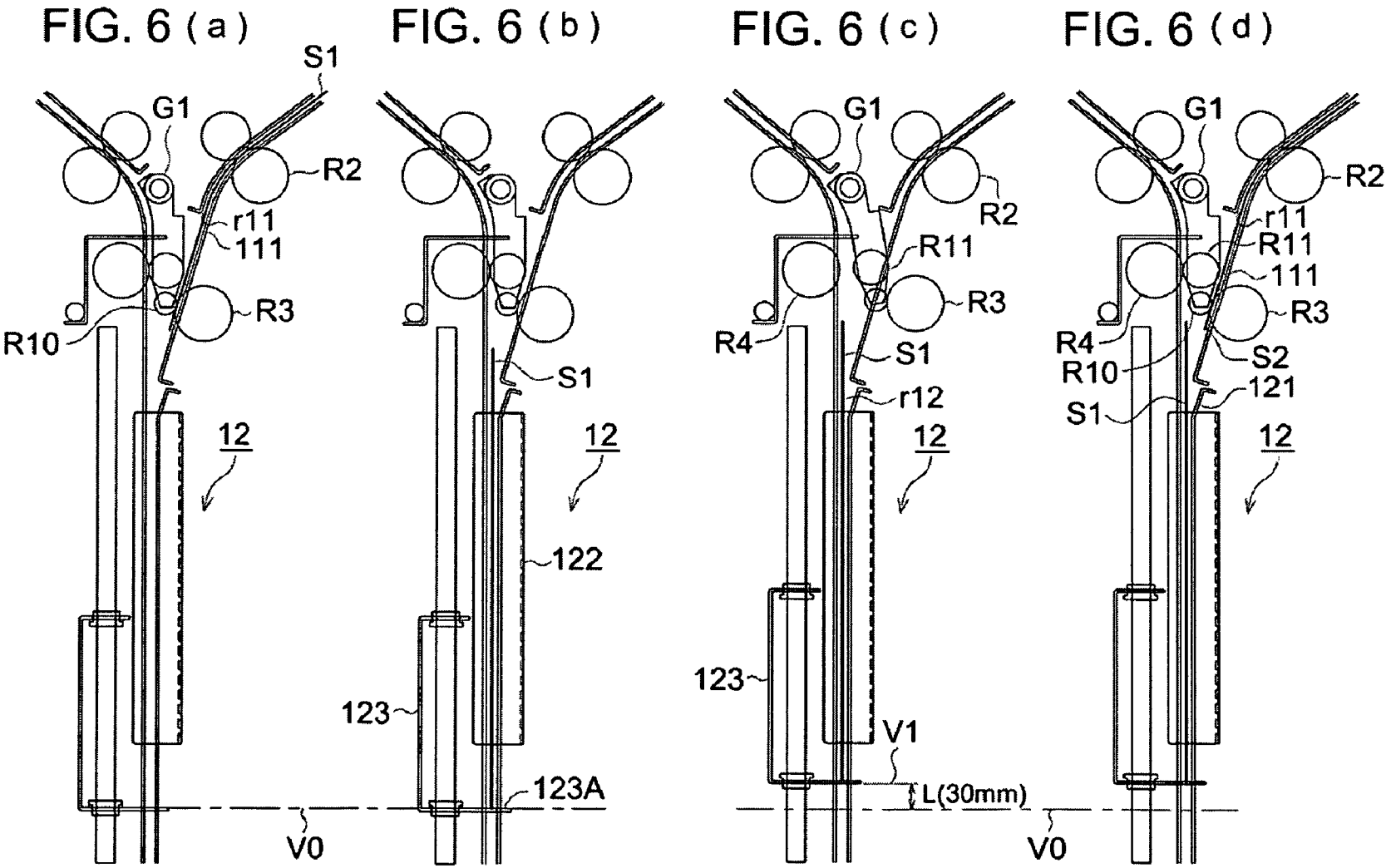

Each of FIGS. 6(*a*)-6(*d*) is a sectional view showing a process of sheet conveyance in the intermediate conveyance unit B1.

Figure 7:
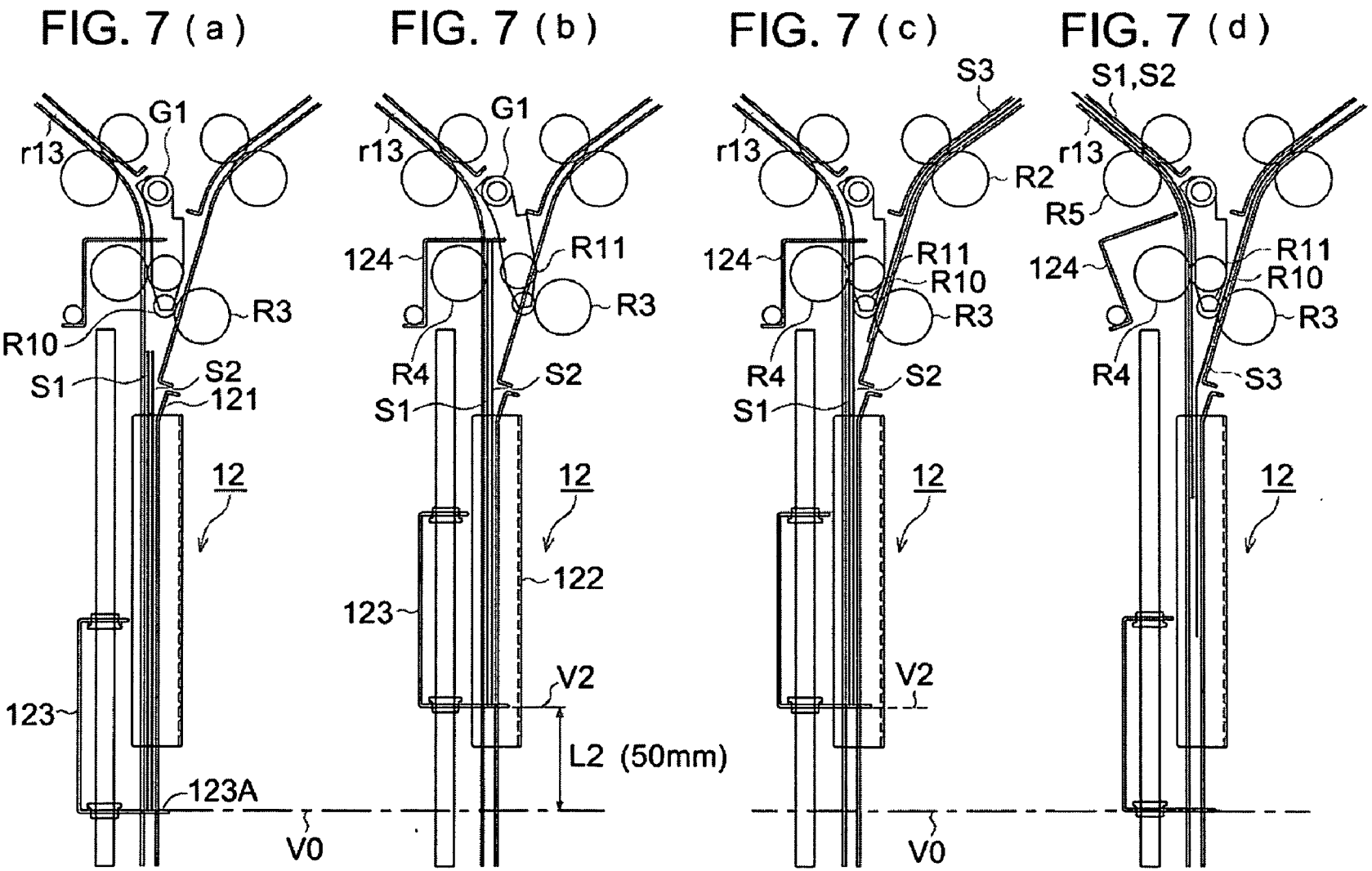

Each of FIGS. 7(*a*)-7(*d*) is a sectional view showing a process of sheet conveyance in the intermediate conveyance unit B1.

Figure 8:
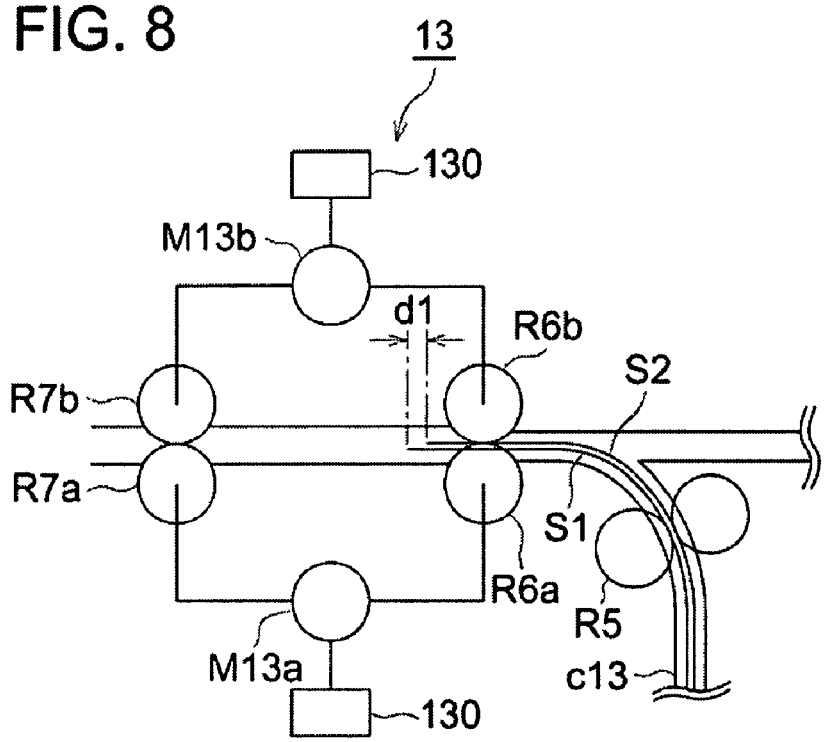

FIG. 8 is a sectional view showing driving devices in the circumference of sheet drive-out section 13 of the intermediate conveyance unit B1.

Figure 9:
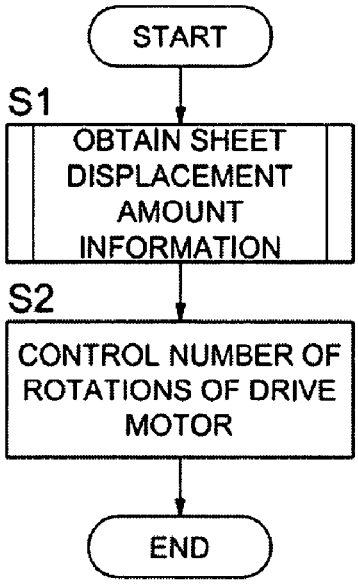
Figure 9:
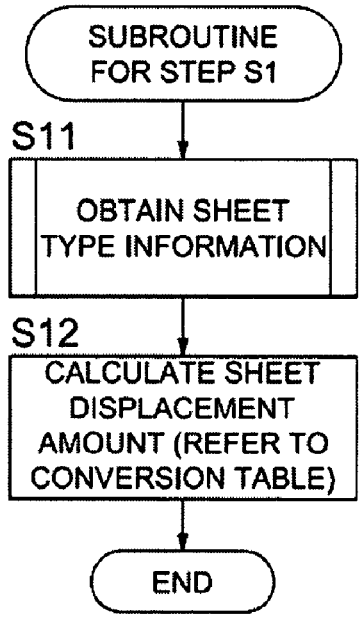

Each of FIGS. 9(*a*) and 9(*b*) is a diagram showing a control flow of a sheet finisher relating to the first embodiment.

Figure 10:
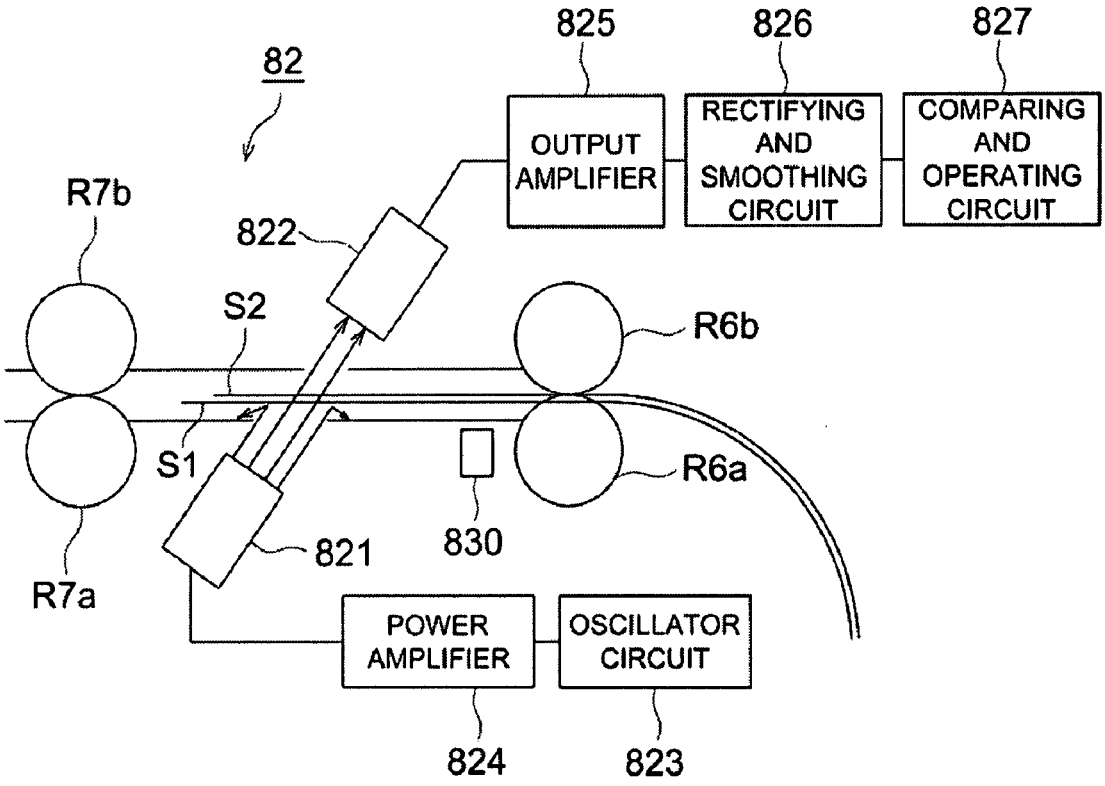

FIG. 10 is a sectional view of the circumference of the sheet drive-out section 13 of the intermediate conveyance unit B1 relating to the second embodiment.

DETAILED DESCRIPTION OF THE PREFERRED EMBODIMENT

The invention will be explained as follows, referring to the embodiment to which, however, the invention is not limited.

Figure 1:
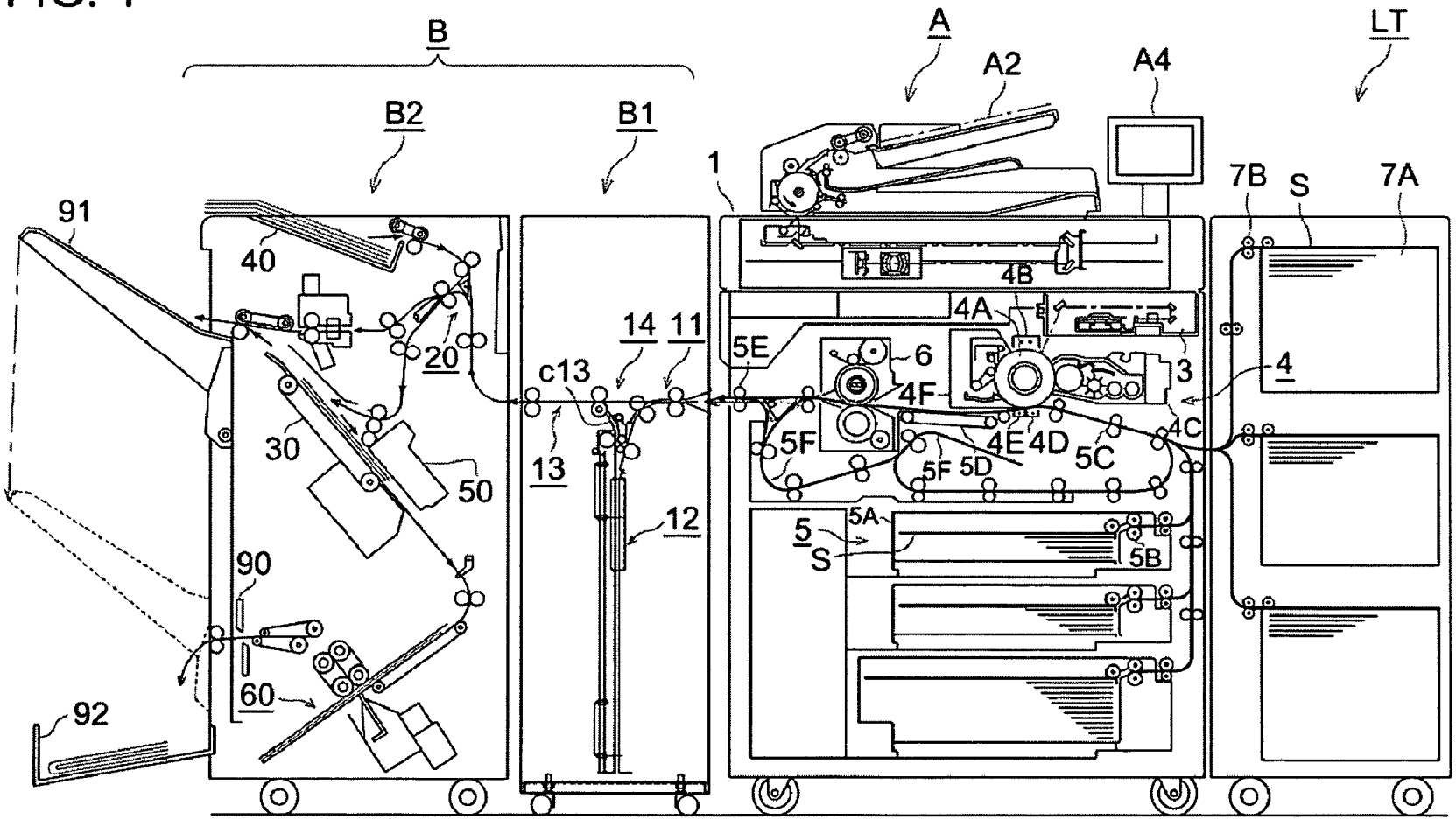
FIG. 1 is an overall structural diagram of an image forming system having therein image forming apparatus A, sheet finisher B and large capacity sheet tray LT.

FIG. 1 is an overall structural diagram of an image forming system having therein image forming apparatus A, sheet finisher B and large capacity sheet tray LT. The sheet finisher B has intermediate conveyance unit B1 and finishing section B2.

[Image Forming Apparatus A]

The illustrated image forming apparatus A is equipped with image reading section 1, image writing section 3, image forming section 4, sheet feeding and conveying section 5, fixing device 6, automatic document feeder A2 and with operation and display section A4.

The image forming section 4 is composed of photoreceptor drum 4A, charging section 4B, developing section 4C, transfer section 4D, separation section 4E and cleaning section 5F.

The sheet feeding and conveying section 5 is equipped with sheet feeding cassette 5A, first sheet feeding section 5B, second sheet feeding section 5C, conveyance section 5D, ejection section 5E and with automatic duplex unit (ADU) 5F.

The operation and display section A4 is equipped with a touch panel wherein a touch screen is arranged on a display section composed of a liquid crystal panel. Owing to the operation and display section A4, various operation images can be displayed, and information of a type of post-processing or information of a type of a sheet to be stored in sheet feeding cassette 5A can be inputted.

Images on one side or on both sides of a document placed on a document platen of automatic document feeder A2 are read by an optical system of image reading section 1, and analog signals through photoelectric conversion are sent to image writing section 3 after being subjected to processing operations in image processing section 2 such as analog processing, A/D conversion, shading correction and image compression processing.

In the image writing section 3, light outputted from a semiconductor laser is irradiated on photoreceptor drum 4A of image forming section 4, and a latent image is formed. In the image forming section 4, processing operations such as charging, exposure, developing, transfer, separation and cleaning are conducted.

Images are transferred onto sheet S conveyed by first sheet feeding section 5B by transfer section 4D. The sheet S carrying images is fixed by fixing device 6, and is fed into intermediate conveyance unit B1 from sheet ejection section 5E. Or, the sheet S which has been finished in terms of image processing on its one side and has been fed into the automatic diplex unit 5F is subjected to image processing on both sides in the image forming section 4 again, and then, is ejected to the sheet ejection section 5E to be fed into the intermediate conveyance unit B1.

[Large Capacity Sheet Tray LT]

The large capacity sheet tray LT is composed of sheet stacking section 7A and first sheet feeding section 7B, and it can convey a large amount of sheets S continuously to feed them into image forming apparatus A.

[Sheet Finisher B]

As stated above, the sheet finisher B has therein intermediate conveyance unit Bi and finishing section B2. The intermediate conveyance unit Bi will be explained in detail later.

In the finishing section B2, insertion sheet feeding section 40 storing therein insertion sheets (which are used for a cover and a back cover), stacking section 30, stapling section 50 and folding section 60 are arranged tandem almost vertically in this order from the upper part in the illustration. Further, in the vicinity of the folding section 60, there is arranged cutting section 90 that cuts edges of a saddle-stitched booklet. Though the cutting section is provided on the finishing section B2 in the present embodiment, it is also possible to arrange so that a booklet is cut by a general purpose cutting machine separately after the booklet is ejected.

Entrance conveying section 20 is arranged at an upper part on the right side of the illustration of the finishing section B2 for a sheet. Further, on the left side of the illustration of the finishing section B2 for a sheet, there are arranged movable ejection tray 91 that copes with a printing job to eject a printed sheet as it is to stack without doing post-processing and stationary ejection tray 92 on which the saddle-stitched booklets thus bound are stacked.

Figure 2:
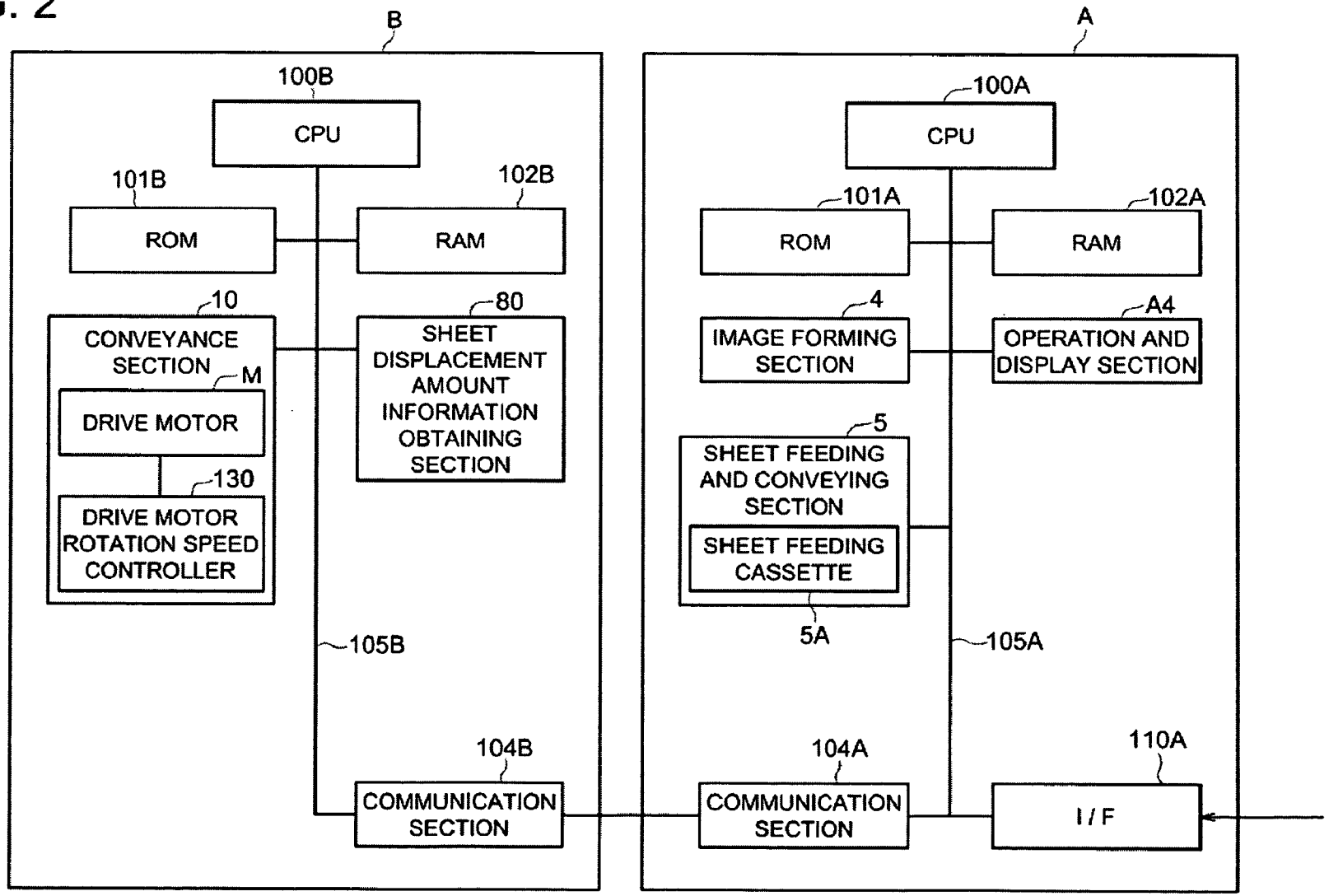
FIG. 2 is a block diagram of a controller system in the image forming system.

FIG. 2 is a block diagram of a controller system in the image forming system. In FIG. 2, the circumference of the portion necessary for explanation of operations of the present embodiment is mainly described, and other known portions as the image forming system are omitted. In the figures thereafter, common parts are given the same symbols to omit the explanation for the purpose of avoiding duplication of the explanation.

Numeral 100A represents CPU that functions as a controller device conducting various controls of image forming apparatus A in accordance with a program. Numeral 101A represents ROM that stores various types of programs and data including programs and data for controlling the image forming apparatus A. The symbol 102A represents RAM that is used by CPU 100A as a work area, and it temporarily stores programs, data or printing jobs which are necessary when CPU 100A controls image forming apparatus A.

Then, the CPU 100A functions as a controller, and controls image forming apparatus A based on programs, data and printing jobs developed on RAM 102A. 110A represents an interface (I/F) serving as a communication device that communicates through a network such as LAN.

The symbol 104A represents a communication section which is connected to sheet finisher B and it sends and receives various types of data such as sheet type information, output number of sheets information and post-processing information, between itself and sheet finisher B. The symbol 105A represents a bus through which ROM 101A, RAM 102A, image reading section A2, image forming section 4, operation and display section A4, sheet feeding section 5 and communication section 104A representing a transmission device are connected to each other.

In the sheet finisher B, ROM 101B, RAM 102B, conveyance section 10, sheet displacement amount information obtaining section 80 and communication section 104B are connected each other, centering around CPU 100B that controls sheet finisher B variously in accordance with a program. ROM 101B stores various types of programs and data, and CPU 100B controls sheet finisher B by using these programs and data. RAM 102B is used by CPU 100B as a work area, while, CPU 100B stores temporarily programs and data which are needed when CPU 100B controls. Communication section 104B that conducts data communication is connected to image forming apparatus A to transmit and to receive various types of data such as sheet type information and others between itself and image forming apparatus A.

Conveyance section 10 has drive motor M that drives a conveyance roller and motor rotation speed controller 130 that controls the rotation speed (number of revolutions) of the drive motor M.

The sheet displacement amount information obtaining section 80 acquires information of an amount of displacement between respective sheets in the case of conveying plural (superposed) sheets (hereinafter referred to as sheet displacement amount). AS a sheet displacement amount acquired by the sheet displacement amount information obtaining section 80, there are occasions including (1) where a calculated assessed value (probable value) is also used and (2) where an actual measurement by a detection sensor provided in sheet finisher B is used. As an example of the former, there is an occasion where the sheet displacement amount is estimated from sheet type information of the sheet to be conveyed by an intermediate conveyance unit. As an example of the latter, there is an occasion where an actual sheet displacement amount is measured by an ultrasonic sensor representing a detection sensor. Details of the sheet displacement amount information obtaining section 80 will be described later. Incidentally, CPU 100B and drive motor rotation speed controller 130 function as "correction controller".

[Intermediate Conveyance Unit]

Figure 3:
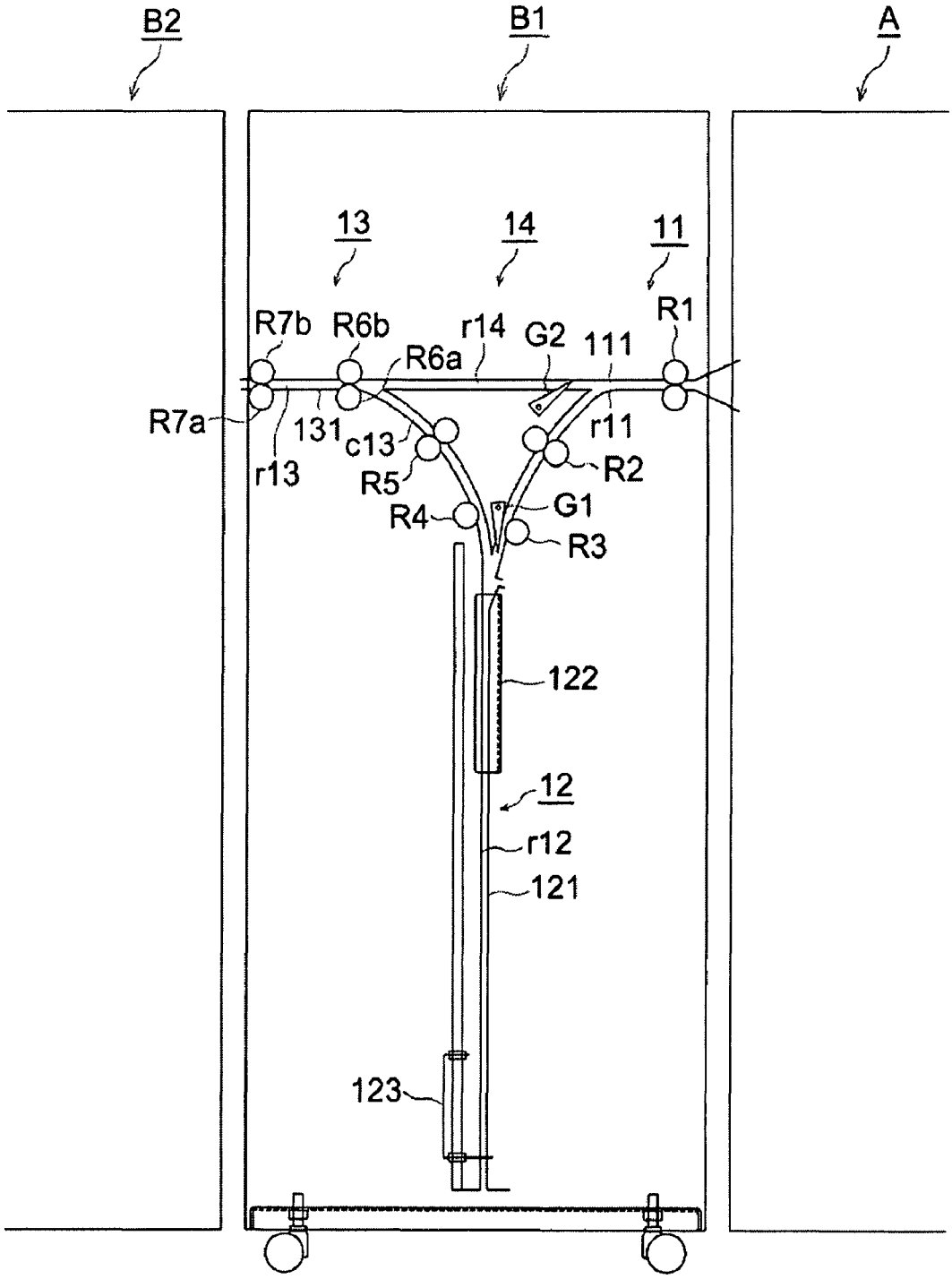
FIG. 3 is a front sectional view of intermediate conveyance unit B1.

FIG. 3 is a front sectional view of intermediate conveyance unit B1.

The intermediate conveyance unit B1 is composed of sheet-carry-in section (first conveyance section) 11, intermediate storing section (second conveyance section) 12, sheet-drive-out section (third conveyance section) 13 and of by-pass conveyance section (fourth conveyance section) 14.

The sheet-carry-in section 11 is equipped with conveyance rollers R1 and R2 and sheet conveyance path r11 having guide plate 111. In the sheet-carry-in section 11, sheets S ejected from ejection section 5E of image forming apparatus A are accepted in order of precedence to be conveyed.

The intermediate storing section 12 is equipped with two guide plates 121 arranged to be in parallel each other, horizontal alignment section 122, a vertical alignment section having therein stopping member 123 and vertical alignment member 124, carry-in drive roller R3, drive-out drive roller R4 and sheet conveyance path r12. In the intermediate storing section 12, a plurality of sheets S accepted from the sheet-carry-in section 11 are stored under the superposed condition to be aligned, and then, are ejected upward.

The sheet-drive-out section 13 is equipped with intermediate conveyance roller R5, sheet conveyance path r13 having a pair of sheet-ejection rollers R6*a* and R6*b* (which is also called a pair of conveyance rollers) and a pair of sheet-ejection rollers R7*a* and R7*b* and guide plate 131 and with curved conveyance section c13. In the sheet-drive-out section 13, a plurality of sheets S stored in the intermediate storing section 12 are reversed and conveyed while they are superposed to be sent in succeeding finishing section B2.

The by-pass conveyance path 14 is equipped with sheet conveyance path r14. Sheet conveyance to the by-pass conveyance path 14 is conducted on the occasion when it is not necessary to convey to the intermediate storing section 12. For example, the occasion is that the sheets do not need post-processing, or that when sheets are conveyed under the condition of establishment where space-between-sheets of sheets is broad such as the occasion of non-continuous printing.

Conveyance path switching section G2 arranged at the sheet-carry-in section 11 is branched to either by-pass conveyance path 14 or the intermediate storing section 12. On the upper part of the intermediate storing section 12, there is arranged conveyance path switching section GI. The conveyance path switching section G1 switches between introduction of sheet S to the intermediate storing section 12 and ejection of sheet S from the intermediate storing section 12. Each of the conveyance path switching sections G1 and G2 is connected to a solenoid to be driven.

Figure 4:
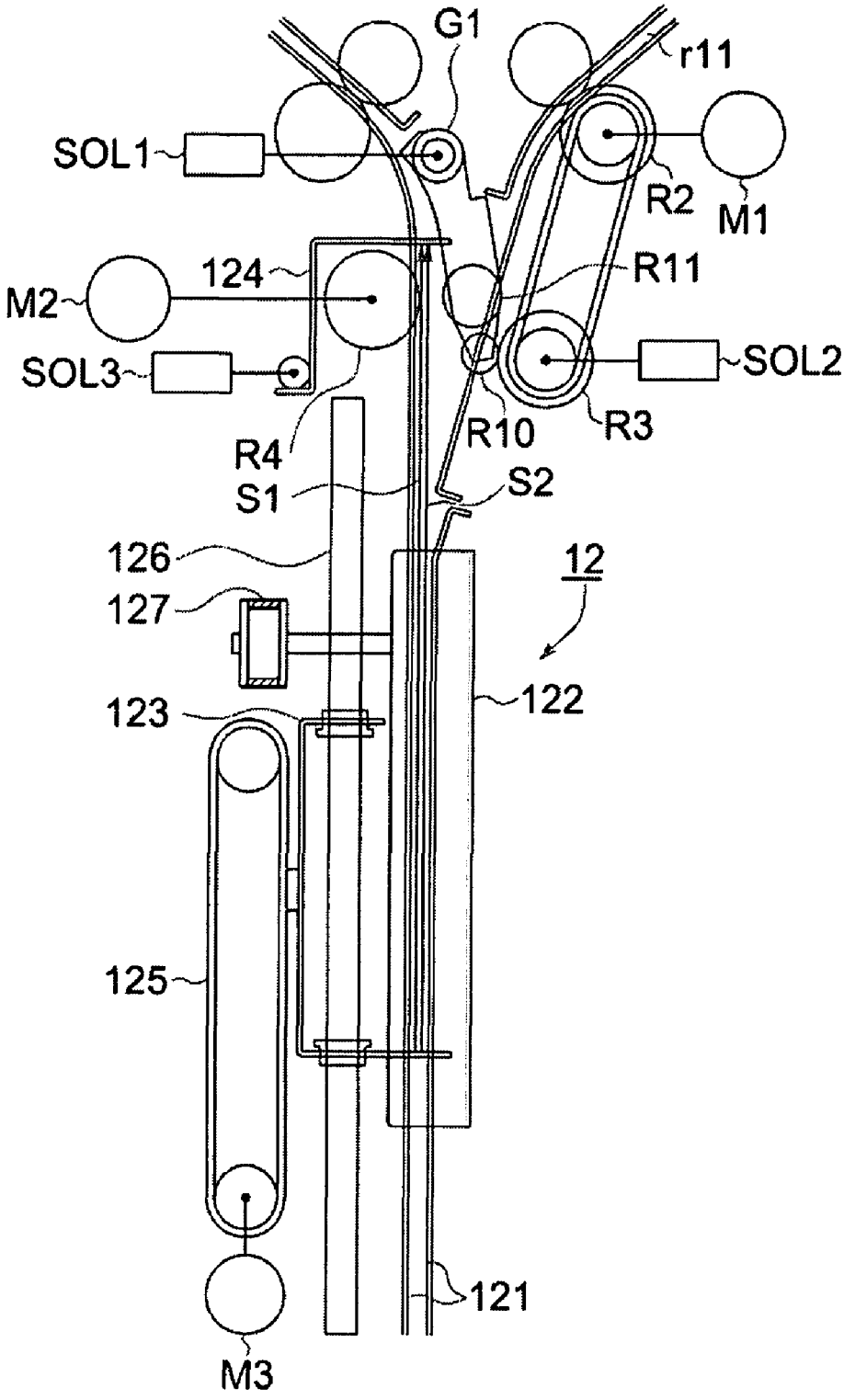
FIG. 4 is a sectional view showing driving devices in the circumference of intermediate storing section 12 of the intermediate conveyance unit B1.

FIG. 4 is a sectional view showing driving devices in the circumference of intermediate storing section 12 of the intermediate conveyance unit B1. The conveyance path switching section G1 supporting carry-in driven roller R10 and drive-out driven roller R11 is driven by solenoid SOL1 to be swung. The carry-in drive roller R3 is driven by solenoid SOL2 to open or close the sheet conveyance path r11. Vertical alignment member 124 is driven by solenoid SOL3 to be swung.

Motor M1 drives conveyance roller R2 to rotate so that the carry-in drive roller R3 is rotated through a belt. Motor M2 drives drive-out drive roller R4 to rotate.

Stopping member 123 is fixed on belt 125 rotated by motor M3, and is guided by guide bar 126 to go up and down.

Figure 5:
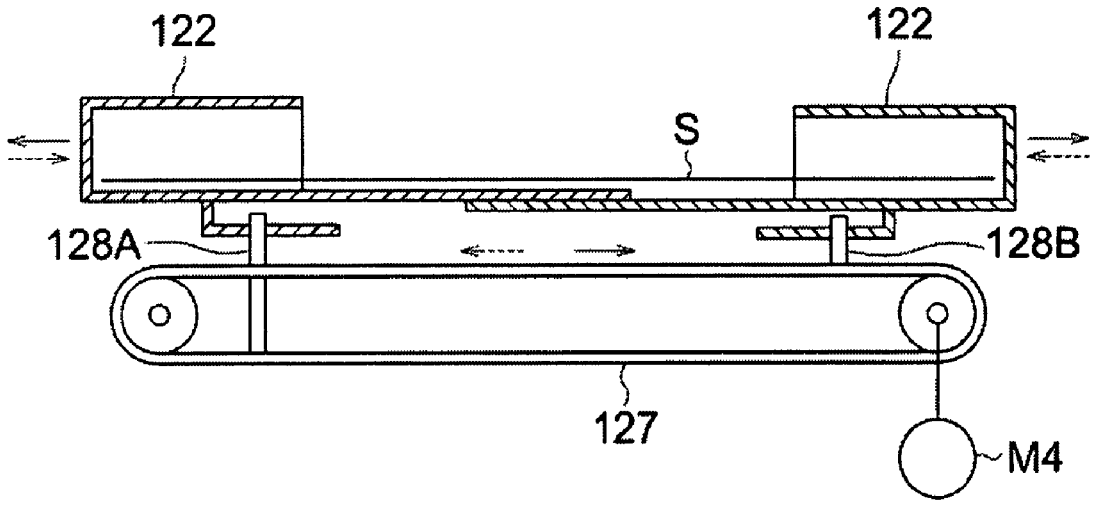
FIG. 5 is an upward sectional view showing a driving device for horizontal alignment plate 122.

FIG. 5 is an upward sectional view showing a driving device for horizontal alignment plate 122. A pair of horizontal alignment sections 122 are engaged with pins 128A and 128B fixed on belt 127 rotated by motor M4, to move in the lateral direction of a sheet for width alignment.

Each of FIGS. 6(*a*)-6(*d*) and FIGS. 7(*a*)-7(*d*) is a sectional view showing a process of sheet conveyance in the intermediate conveyance unit B1. A process of sheet conveyance in the intermediate conveyance unit B1 will be explained as follows.

(1) In FIG. 6(*a*), carry-in driven roller R10 supported at a tip of the conveyance path switching section G1 on a rotatable basis is in pressure contact with the carry-in drive roller R3 to be driven to rotate. First sheet S1 that is interposed by conveyance rollers R2 which rotate on a driving basis to be conveyed is moved along guide plate 111 of sheet conveyance path r11, then, is interposed by the carry-in drive roller R3 to be conveyed, and advances toward intermediate storing section 12.

(2) In FIG. 6(*b*), a leading edge portion of the first sheet S1 conveyed to the intermediate storing section 12 comes in contact with stopping surface section 123A of stopping member 123, and stops.

(3) In FIG. 6(*c*), conveyance path switching section G1 is caused to operate to make drive-out driven roller R11 supported on a middle portion of the conveyance path switching section G1 on a rotatable basis to leave drive-out drive roller R4. In this case, carry-in drive roller R3 is pressed by the drive-out driven roller R11 to be swung around conveyance roller R2, and it retreats. After that, the stopping member 123 is moved by an unillustrated driving device to the first position V1 that is lifted from initial position V0 by prescribed distance L1 (for example, 30 mm), whereby, a leading edge portion of sheet S arrives at the neighborhood of the drive-out drive roller R4, and the sheet S stops.

(4) In FIG. 6(*d*), the conveyance path switching section G1 is restored and the carry-in drive roller R3 is restored simultaneously, whereby, the carry-in drive roller R3 rotating on a driving basis and the carry-in driven roller R10 come into pressure contact each other. Concurrently with this, the drive-out drive roller R4 and the drive-out driven roller R11 come into pressure contact each other. The second sheet S2 interposed by conveyance roller R2 to be conveyed is moved along guide plate 111 of sheet conveyance path r11, then, is interposed between the carry-in drive roller R3 and the carry-in driven roller RIO to be conveyed, and advances toward intermediate storing section 12.

(5) In FIG. 7(*a*), the second sheet S2 is moved along guide plate 121 of sheet conveyance path r12 of the intermediate storing section 12, and the stopping member 123 is returned to its initial position V0 by the driving device after the leading edge portion of the second sheet has passed through the interposing section between the carry-in drive roller R3 and the carry-in driven roller R10. The leading edge portion of the second sheet S2 comes in contact with stopping surface section 123A of stopping member 123, and stops. In this stopping position, the second sheet S2 is superposed on the first sheet S1 entirely.

(6) In FIG. 7(*b*), conveyance path switching section G1 is caused to operate to make drive-out driven roller R11 to leave drive-out drive roller R4, in the same way as in FIG. 6(*c*). After that, the stopping member 123 is moved by an unillustrated driving device to the second position V2 that is higher than prescribed distance L1 and is higher than initial position V0 by prescribed distance L2 (for example, 50 mm), and an upper end portion of the superposed two sheets S1 and S2 comes in contact with stopping surface section 124A of vertical alignment member 124 to stop, thus, highly accurate vertical alignment is carried out. The position for the upper end portion of the vertically aligned two sheets S1 and S2 to stop is at the downstream side of a nip position of drive-out drive roller R4 in the conveyance direction. Concurrently with the vertical alignment or after the vertical alignment, horizontal alignment section 122 is driven by an unillustrated driving source to press side edges of sheets S1 and S2 in their lateral directions to carry out horizontal alignment.

(7) In FIG. 7(*c*), the conveyance path switching section G1 is restored and the carry-in drive roller R3 is restored simultaneously in the same way as in FIG. 6(*d*), whereby, the carry-in drive roller R3 rotating on a driving basis and the carry-in driven roller R10 come into pressure contact each other, to interpose the leading edge portion of the third sheet S3 so that it may be conveyed. Concurrently with this, the drive-out drive roller R4 and the drive-out driven roller R11 come into pressure contact each other, to interpose an upper end portion of the superposed two sheets S1 and S2.

(8) In FIG. 7(*d*), vertical alignment member 124 is driven by an unillustrated solenoid to leave sheet conveyance path r13. Two sheets S1 and S2 interposed between the drive-out drive roller R4 and the drive-out driven roller R11 are conveyed by rotation of the drive-out drive roller R4 on a driving basis, and are further interposed by intermediate conveyance roller R10 to be ejected. Virtually simultaneously with this, the third sheet S3 interposed between carry-in drive roller R3 and carry-in driven roller R10 to be conveyed advances toward the intermediate storing section 12.

Intermediate conveyance unit B1 is equipped with carry-in drive roller R3 supported an a rotatable basis and with carry-in driven roller R10 that comes in pressure contact with the carry-in drive roller R3 and rotates on a driven basis, and it can conduct firmly switching between a sheet conveyance path for sheet carry-in and retreat in the case of drive-out of superposed sheets.

By reversing two or more sheets S while they are superposed through intermediate storing section 12 of intermediate conveyance unit B1, and thereby, by ejecting them to succeeding finishing section B2, it is possible to eliminate stagnated time of sheet reversing and conveying in image forming apparatus A, and to make rapid reversing and conveying to be possible.

In the mean time, the number of sheets S stored in intermediate storing section 12 is not limited to two, and it is also possible to establish the number of sheets to be three or more based on post-processing establishment of succeeding finishing section B2.

Further, in the embodiment shown in FIG. 3 through FIG. 7(*d*), an angle formed by the sheet conveyance direction and stopping surface section 123A of stopping member 123 is made to be a right angle substantially. In addition to the foregoing, however, it is also possible to arrange so that an angle formed by the sheet conveyance direction and stopping surface section 123A of stopping member 123 may be an acute angle, such as, for example, 30° -60°, (by rotating the stopping surface section 123A counterclockwise in FIG. 7(*a*)) so that an amount of sheet displacement may be canceled, by considering, in advance, an amount of sheet displacement that may be caused at the downstream side in the conveyance direction. Owing to this, it is possible to superpose two or more sheets in intermediate storing section 12 to be displaced in the direction that is opposite to the direction in which the sheet displacement may be caused in future.

[Amount of Sheet Displacement and its Correction Control]

FIG. 8 is a sectional view showing driving devices in the circumference of sheet drive-out section 13. As shown in FIG. 8, the sheet drive-out section 13 has curved conveyance section c13. When superposed plural sheets are conveyed as they are through the curved conveyance section c13, sheet S1 located inside of the curved portion and sheet S2 located outside are different in terms of a length of a path in the conveyance path and of frictional force between a wall surface of the curved portion and a sheet. Due to this, sheet displacement is caused in the conveyance direction between the inside sheet and the outside sheet as shown in FIG. 8 in which the inside sheet S1 is conveyed earlier, resulting in sheet displacement equivalent to a length d1.

Among a pair of sheet ejection rollers R6*a* and R6*b* and a pair of sheet ejection rollers R7*a* and R7*b* of sheet drive-out section 13, rollers (R6*a*, R7*a*) that touch sheet S1 on one side in the case of sheet conveyance and rollers (R6*b*, R7*b*) that touch sheet S2 on the other side are driven by separate drive motors respectively. That is, rollers R6*a* and R7*a* are driven by drive motor M13*a* and rollers R6*b* and R7*b* are driven by drive motor M13*b*.

A rotation speed of each of both drive motors M13*a* and M13*b* can be controlled by drive motor rotation speed controller 130. Incidentally, it is also possible to arrange so that a rotation speed of either one only of drive motors M13*a* and M13*b* is controlled without being limited to the foregoing, though FIG. 8 shows an example wherein rotation speeds of both drive motors are controlled. It is further possible to employ the structure to drive only one roller, though FIG. 8 shows an example to drive two rollers respectively by drive motors M13*a* and M13*b*.

[Sheet Displacement Amount Information]

Correction is made so that a displacement amount of superposed plural sheets is eliminated, when correction controllers (CPU 100B and motor rotation speed controller 130) control drive motors M13*a* and M13*b* to show appropriate rotation speeds. A control flow about the correction will be explained as follows.

Each of FIGS. 9(*a*) and 9(*b*) is a diagram showing a control flow of a sheet finisher relating to the first embodiment. In FIG. 9(*a*), sheet displacement amount information is acquired first in step S1.

FIG. 9(*b*) is a diagram showing sub-routine processing concerning sheet displacement amount information acquisition (step S1). In step S11, sheet type information for the sheet to be conveyed by intermediate conveyance unit B1 is acquired. Acquisition of sheet type information is conducted from image forming apparatus A through communication sections 104B and 104A. Meantime, the sheet type information is correlated with sheet feeding cassette 5A storing therein a sheet for image forming, when a user operates operation and display section A4 in advance, as stated above. "The sheet type information" in this case means those including sheet basic weight (g/m$^2$), a direction of texture of sheet, information of sheet type, and a brand of sheet. Further, the sheet type information includes, for example, coated paper, plain paper, thick paper and rough paper.

These pieces of "sheet type information" are used to estimate stiffness of sheet to be conveyed through a sheet finisher, a sheet thickness and friction force between a sheet surface and a wall surface of a conveyance path. The reason for the foregoing is that these factors have an influence on a sheet displacement amount in the case of conveying superposed plural sheets through the sheet finisher.

In step S12, a sheet displacement amount is calculated through a reference by correlating the sheet type information acquired in step S11 with a conversion table stored in ROM 101B in advance, to return to the control flow in FIG. 9(*a*). In the meantime, in the first embodiment, a series of these operations cause communication section 104B and a correction control section to function as sheet displacement amount information obtaining section 80.

Now, the conversion table will be explained here. Since the sheet displacement amount shows the same value, if (a) a form of a path of curved conveyance section c13 of intermediate conveyance unit B1, (b) the number of sheets to be superposed at the intermediate conveyance unit and (c) sheet type information are the same, whereby, the conversion table concerning the sheet displacement amount is derived from results of various experiments made in advance. On the conversion table, a sheet displacement amount for thicker sheets tends to be greater than that for thinner sheets, and a sheet displacement amount for lower smoothness sheets tends to be greater than that for higher smoothness sheets.

In step S2, a rotation speed of each of drive motors M13*a* and M13*b* is controlled through motor rotation speed controller 130 based on sheet displacement amount information acquired in step S1. As control of rotation speed, when total length L of curved conveyance section c13 is 100 mm and sheet displacement amount d1 after passing through curved conveyance section c13 is 1 mm, for example, a ratio of speed difference between inside sheet S1 and outside sheet S2 is shown by d1/L=1/100=1%. The rotation speed has only to be corrected by an amount equivalent to this value. For example, the rotation speed of M13*a* is raised by 0.5% and the rotation speed of M13*b* is lowered by 0.5%.

Incidentally, though the embodiment to acquire sheet displacement information in step S1 has been explained, it is also possible to arrange to control the rotation speed of the drive motor with a correction controller so that the rotation speed may become a prescribed rotation speed corresponding to the number of sheets to be superposed, by omitting the step S1.

It is possible to provide a sheet finisher capable of raising productivity by conveying plural sheets while they are superposed, and of conducting post-processing highly accurately without causing sheet displacement, by realizing a sheet finisher having two drive motors to drive separately a roller touching a sheet on one hand and a roller touching a sheet on the other side among a pair of conveyance rollers on the downstream side of intermediate storing section 12, depending on an amount of sheet displacement and having a correction controller that controls the rotation speed of at least one of the two drive motors.

Second Embodiment

FIG. 10 is a sectional view of the circumference of the sheet drive-out section 13 of the intermediate conveyance unit B1 relating to the second embodiment. In the example shown in FIG. 10, sheet quantity detecting section 82 (sheet displacement amount detecting section) is used as sheet displacement amount information obtaining section 80. The sheet quantity detecting section 82 shown in FIG. 10 is one which is also called the so-called a multi-feed detection sensor of a supersonic type.

The sheet quantity detecting section 82 is composed of supersonic wave transmitter 821 on which a piezoelectric element is arranged and of supersonic wave receiver 822, and a supersonic wave is transmitted from the super sonic wave transmitter 821 toward sheet S and the supersonic wave transmitted through sheet S is received by supersonic wave receiver 822. An output from the supersonic wave receiver 822 is compared with a threshold value established in advance to be distinguished, and the number of sheets conveyed is detected. Specifically, the output received by the supersonic wave receiver 822 is amplified and smoothed by output amplifier 825 and rectifying and smoothing circuit 826, and then, is compared with a threshold value by comparing and operating circuit 827 to be distinguished. Then, the sheet displacement amount is detected by time fluctuation of the number of sheets thus detected.

Oscillator circuit 823 is a pulse generation circuit, and it is possible to adjust sensitivity of a sheet thickness detecting circuit by adjusting a pulse frequency. Power amplifier 824 drives supersonic wave transmitter 821 by amplifying a pulse coming from the oscillator circuit 823. Output amplifier 825 amplifies an output of supersonic wave receiver 822. In the comparing and operating circuit 827, an output level of the rectifying and smoothing circuit 826 is compared with a threshold value inputted into an internal memory in advance to judge the number (thickness) of sheets.

When sheets are not conveyed, supersonic waves are not attenuated and an output is greatest, when single sheet S is conveyed, a level of attenuation of supersonic waves caused by the sheet S is low, and when superposed plural sheets S are conveyed, a level of attenuation of supersonic waves caused by the sheets S is high, and therefore, an output level of supersonic wave receiver 822 is lowered, which is detected.

A frequency of a supersonic wave is established to be, for example, 200 kHz. Timing of passing for a sheet is detected by sheet passing detection sensor 830 of a photodetector type, and a supersonic wave is oscillated from the supersonic wave transmitter 821 in synchronization with the detected timing. Each of (a) the condition of no sheet, (b) the condition of passing of a single sheet and (c) the condition of passing of plural sheets is distinguished by the comparing and operating circuit 827, and its timing is used to detect an amount of sheet displacement.

Incidentally, an output received by supersonic wave receiver 822 in each of the aforesaid (b) and (c) varies depending on types of sheets such as a sheet thickness to be detected. For correcting the foregoing, it is also possible to take measures wherein a sheet quantity detecting section for comparison is provided also on the intermediate storing section 12, and plural sheets stored in the intermediate storing section 12 are measured by the sheet quantity detecting section for comparison, and this measured value is used to correct the aforesaid threshold value with which the output level of the rectifying and smoothing circuit 826 is compared. These measures make it possible to cope with an influence on an output caused by changes of sheet types. The same thing can also be made possible by another method wherein the output of the sheet quantity detecting section 82 in the case of passing of plural sheets are reflected in correction of threshold value for the sheet in the succeeding group, without providing plural sheet thickness detecting sections.

Although an example to use a sensor of a supersonic wave type as a device to detect a sheet displacement amount has been explained in the embodiment shown in FIG. 10, it is also possible to employ a method to detect the number of sheets by an amount of light transmitted through the sheet in the optical system using transmitted light, and thereby to detect an sheet displacement amount by its timing, without being limited to the foregoing.

Further, information of a conveyance length for a single sheet to be conveyed is acquired in advance from image forming apparatus A, and a length (passing time) for plural superposed sheets passing through sheet drive-out section 13 is calculated by sheet detection sensor 830. Then, the sheet length thus calculated is compared with the information of a conveyance length, and an amount equivalent to the difference obtained by the comparison may also be used as information of a sheet displacement amount for the succeeding group.

The embodiment of the invention makes it possible to obtain a sheet finisher wherein productivity is improved by conveying plural sheets as they are superposed, and post-processing can be carried out at highly accurately without causing sheet displacement.

What is claimed is:

1. A sheet finisher having a post-processing section that conducts post-processing on a sheet on which an image has been formed by an image forming apparatus, the sheet finisher comprising:

(a) an intermediate storing section in which a plurality of sheets conveyed from the image forming apparatus are superposed to be stored temporarily;

(b) a pair of conveyance rollers that convey the plurality of sheets stored in the intermediate storing section to the post-processing section while the plurality of sheets are superposed, wherein the pair of conveyance rollers rotate in a sheet conveyance direction;

(c) two drive motors, wherein each of the two motors drives one of the pair of conveyance rollers that comes in contact with one sheet of the plurality of sheets and the other of the pair of conveyance rollers that comes in contact with the other sheet of the plurality of sheets, separately;

(d) a sheet displacement amount information obtaining section which obtains an amount of a sheet displacement of the superposed plurality of sheets relative to each other in the sheet conveyance direction, which is generated downstream of the intermediate storing section; and (e) a correction controller that controls a rotation speed of at least one of the two drive motors based on the obtained amount of the sheet displacement so that the sheet displacement amount is eliminated.

2. The sheet finisher of claim 1, wherein the plurality of sheets consist of two sheets.

3. The sheet finisher of claim 1, further comprising a communication section which communicates data with the image forming apparatus, and the correction controller controls the rotation speed of the drive motors according to sheet type information received from the communication section.

4. The sheet finisher of claim 1, further comprising a sheet displacement amount detecting section which detects the sheet displacement amount of sheets that are interposed and conveyed downstream of the intermediate storing section, and the correction controller controls the rotation speed of the drive motors according to the sheet displacement amount detected by the sheet displacement amount detecting section.

5. The sheet finisher of claim 4, wherein the sheet displacement amount detecting section obtains the amount of sheet displacement by comparing the sheet length of the superposed sheets with information of a conveyance length for a single sheet obtained from the image forming apparatus.

6. The sheet finisher of claim 1, wherein the correction controller controls a rotation speed of at least one of the two drive motors based on sheet type information on which the sheet is conveyed to the post-processing section.

7. An image forming system comprising:

an image forming section which forms an image on a sheet; and the sheet finisher of claim 1 that conducts post-processing on the sheet on which the image has been formed by the image forming section.

8. The sheet finisher of claim 1, wherein the sheet displacement amount is calculated through a reference by correlating sheet type information obtained from the image forming apparatus with a conversion table stored in the finisher.

* * * * *